US010981687B2

(12) United States Patent
Held

(10) Patent No.: US 10,981,687 B2
(45) Date of Patent: Apr. 20, 2021

(54) METHOD, DEVICE AND SYSTEM FOR OPENING VALUABLE DOCUMENT PACKAGES

(71) Applicant: GIESECKE+DEVRIENT CURRENCY TECHNOLOGY GMBH, München (DE)

(72) Inventor: Steffen Held, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 194 days.

(21) Appl. No.: 16/311,412

(22) PCT Filed: Jun. 21, 2017

(86) PCT No.: PCT/EP2017/000720

§ 371 (c)(1),
(2) Date: Dec. 19, 2018

(87) PCT Pub. No.: WO2017/220201

PCT Pub. Date: Dec. 28, 2017

(65) Prior Publication Data

US 2019/0185194 A1 Jun. 20, 2019

(30) Foreign Application Priority Data

Jun. 24, 2016 (DE) ..... 10 2016 007 783.2

(51) Int. Cl.
*B65B 69/00* (2006.01)
*B26F 3/00* (2006.01)
(Continued)

(52) U.S. Cl.
CPC ..... *B65B 69/0033* (2013.01); *B26F 3/002* (2013.01); *B26F 3/06* (2013.01); *G07D 13/00* (2013.01); *G07D 2211/00* (2013.01)

(58) Field of Classification Search
CPC . B65B 69/00; B65B 69/0033; B65B 69/0066; B26F 3/002; B26F 3/06; B43M 7/00; B43M 7/004
See application file for complete search history.

(56) References Cited

U.S. PATENT DOCUMENTS 3,727,364 A * 4/1973 Wiking ..... B65B 69/00 53/492
5,425,219 A * 6/1995 Tanaka et al. ..... B65B 69/0025 414/412
(Continued)

FOREIGN PATENT DOCUMENTS

DE 19529669 A1 2/1997
DE 19922902 A1 11/2000
(Continued)

OTHER PUBLICATIONS

German Search Report from DE Application No. 102016007783.2, dated Jan. 24, 2017.
(Continued)

*Primary Examiner* — Stephen F. Gerrity
(74) *Attorney, Agent, or Firm* — Workman Nydegger

(57) ABSTRACT

A method and an apparatus are provided for opening value document packages in which value documents are packaged by a packaging material. A region of the packaging material is heated by hot air such that the packaging material opens along a cutting pattern. A system is also provided that includes such an apparatus and a value document package.

20 Claims, 2 Drawing Sheets

(51) Int. Cl.
*B26F 3/06* (2006.01)
*G07D 13/00* (2006.01)

(56) References Cited

U.S. PATENT DOCUMENTS

| | | | | |
|---|---|---|---|---|
| 5,727,747 | A * | 3/1998 | Hannen et al. | B65B 69/0033 242/527 |
| 5,911,666 | A * | 6/1999 | Lancaster, III et al. | B65B 69/00 414/412 |
| 7,647,684 | B2 * | 1/2010 | Redford etal. | B07C 1/02 29/426.4 |
| 9,272,804 | B2 * | 3/2016 | Pippin | B65B 69/0033 |
| 2006/0191426 | A1 * | 8/2006 | Timmerman et al. | B26F 3/002 101/24 |
| 2017/0158369 | A1 | 6/2017 | Dopfer et al. | |

FOREIGN PATENT DOCUMENTS

| | | | | | |
|---|---|---|---|---|---|
| DE | 202005007849 | U1 | | 8/2005 | |
| DE | 102014008607 | A1 | | 12/2015 | |
| EP | 1468920 | A1 | | 10/2004 | |
| EP | 2221251 | A1 | | 8/2010 | |
| EP | 2457837 | A1 | | 5/2012 | |
| GB | 1097859 | A | | 1/1968 | |
| JP | 01111642 | A | * | 4/1989 | B65B 69/0033 |
| JP | 02166033 | A | * | 6/1990 | B65B 69/0033 |
| WO | 03091134 | A1 | | 11/2003 | |
| WO | 2006112712 | A2 | | 10/2006 | |

OTHER PUBLICATIONS

International Search Report and Written Opinion from PCT Application No. PCT/EP2017/000720, dated Sep. 27, 2017.

* cited by examiner

METHOD, DEVICE AND SYSTEM FOR OPENING VALUABLE DOCUMENT PACKAGES

BACKGROUND

The invention relates to a method and an apparatus for opening value document packages in which value documents, in particular banknotes, are packaged with a packaging material, and a system for opening value document packages.

For the transport, value documents, such as, for example, banknotes, checks, coupons or vouchers, which are combined into bundles, are often packaged in foils, on the one hand, to simplify the handling and, on the other hand, to protect the value documents from environmental influences, such as, for example, moisture or dirt, during transport. Prior to further processing of the value documents after the transport, the foil package has to be removed again, for which purpose the latter is usually opened manually, for example by means of scissors or a knife. Manual opening of such a package by means of scissors or a knife is not only time-consuming, but also involves the risk of damage to the value documents located in the package.

SUMMARY

The object of the invention is to specify a method and an apparatus and a system for the rapid and reliable opening of value document packages.

In the method according to the invention for opening value document packages in which value documents, in particular banknotes, are packaged with a packaging material, a region of the packaging material is heated with hot air in such a manner that the packaging material opens along a cutting pattern.

The apparatus according to the invention for opening value document packages in which value documents, in particular banknotes, are packaged with a packaging material, has a hot air nozzle, which is adapted to heat a region of the packaging material with hot air in such a manner that the packaging material opens along a cutting pattern.

The system according to the invention for opening security document packages has an apparatus according to the invention and a value document package with a plurality of value documents packaged with a packaging material.

One aspect of the invention is based on the approach of applying hot air to a region of the packaging material and, while so doing, of heating the latter in such a manner that the packaging material opens, for example by tearing partially or completely open, along a, preferably predeterminable, cutting pattern, at which the heating of the packaging material caused by the hot air is the greatest. The region of the packaging material to which hot air is applied is thereby divided into two or more partial regions, which simplify complete opening and/or removal of the packaging material from the value documents. Depending on the type and state of the packaging material, the latter opens along the cutting pattern automatically, due to a tension of the material produced or intensified by the heating, or after being put under tension additionally with the aid of a tensioning device, in particular in the region heated with hot air. By applying hot air, a weak point is produced in targeted manner in the packaging material in the region of the cutting pattern, at which weak point the strength of the tensioned or put under tension packaging material is locally reduced to such an extent that the latter opens along the cutting pattern.

An opening of the value document package by means of mechanical cutting means such as knives or scissors can thereby be omitted. The action time of the hot air required for the desired weakening of the packaging material can also be controlled by increasing or reducing the temperature of the hot air.

Overall, the invention permits a simple, rapid and reliable opening of value document packages.

In a preferred embodiment, the cutting pattern is a point-shaped, line-shaped, H-shaped, X-shaped, M-shaped or L-shaped cutting pattern, i.e. the packaging material opens substantially along a sectional profile in the form of a point or an area, a straight or curved line or an "H", "X", "M" or "L". Accordingly, in a preferred embodiment of the apparatus, the hot air nozzle is point-shaped, line-shaped, H-shaped, X-shaped, M-shaped or L-shaped. As a result, the region of the packaging material to which hot air is applied is broken down into several partial regions, through which the packaging material can be opened and removed in a particularly simple and reliable manner. Further cutting patterns can be produced by a relative movement between the hot air nozzle and the packaging material.

In a further preferred embodiment, the packaging material is softened or weakened along the cutting pattern by the heating with hot air. Preferably, the heating loosens or reduces the cohesive forces between the atoms or molecules of the packaging material along the cutting pattern. Alternatively or additionally, the heating leads to an unknotting of polymers or molecule chains of the packaging material along the cutting pattern. As a result, the packaging material is pulled apart even at relatively low material tensions in the region of the cutting pattern and is reliably opened or can be reliably opened.

In a further preferred embodiment, the packaging material is configured as a shrink foil which contracts when heated by the hot air, so that the shrink foil opens along the cutting pattern on account of forces arising in the region of the cutting pattern. The tension of the packaging material required for automatic opening is preferably produced solely by the application of hot air. Alternatively or additionally, the shrink foil is already pre-tensioned due to a packaging process carried out at an earlier point in time, in which the shrink foil has already been shrunk. This pre-tensioning leads to the packaging material being softened and pulled apart, in particular partially torn, in the region of a weak point produced by the action of the hot air.

The forces arising during the contraction of the shrink foil in the region of the cutting pattern preferably act within the shrink foil, i.e. tangentially to the surface of the shrink foil. In particular, the arising forces act perpendicularly to the respective profile of the cutting pattern. Preferably, the forces arising during the contraction of the shrink foil in the region of the cutting pattern can be increased advantageously by increasing the temperature of the hot air, since the shrink foil contracts more strongly in this case. Further, the speed of the opening process can also be advantageously influenced; in particular the duration of the opening process can be shortened, preferably to less than three seconds, particularly preferably to less than two seconds.

The shrink foil preferably consists of a polyolefin, in particular polyethylene (PE) or polypropylene (PP). As a result, the shrink foil can be processed particularly easily and safely. In addition, heating particularly reliably brings about a contraction or opening of the packaging material, in which the value documents in the value document package are not damaged. Furthermore, no residues remain on the value documents during the contraction or opening of the shrink foil from a polyolefin.

In a further preferred embodiment, the packaging material is tensioned by a tensioning device in such a manner that, in the region of the cutting pattern, forces are caused or intensified, by means of which the opening of the packaging material is brought about or supported. The packaging material is preferably tensioned in such a manner that the packaging material is partially torn along the cutting pattern in the region of a weak point caused by the action of the hot air. As a result, the opening of the value document package can be carried out particularly reliably.

Preferably, the tensioning device stresses the packaging material in such a manner that the hot air flow can act particularly well on the packaging material and in particular the heat coupling between the hot air and the packaging material is increased. For example, the tensioning of the packaging material prevents the occurrence of irregularities in the region where hot air is applied, so that unintentional turbulences of the hot air, which would transport heat energy away from the packaging material, are advantageously avoided.

Preferably, the forces required for opening the packaging material are produced by stressing the packaging material in particular when a shrink foil no longer contracts or does not contract sufficiently through the heating by means of hot air, so that the shrink foil does not open automatically. This applies in particular to foils which have been heated during a packaging process carried out at an earlier point in time in such a manner that they are in a stable state, in which a further contraction by heating is no longer possible, or if a packaging material has been used that is different from shrink foil.

In a further preferred embodiment, the packaging material is removed after the opening from the value documents located in the value document package by the tensioning device. The packaging material is preferably pulled off the value documents, in particular perpendicularly to the cutting pattern, with the aid of at least one or at least two rotating, in particular rubberized, rollers of the tensioning device. As a result, the opening of the value document package and the removal of the packaging material can be carried out in only one operation.

In a further preferred embodiment, a pre-bundling foil, with which the, in particular bundled, value documents are supplied and held together before packaging with the packaging material, connects with the packaging material in the region heated by means of hot air. As a result, for opening the value document package, advantageously only one packaging layer needs to be opened that is composed of the packaging material and the pre-bundling foil.

In a further preferred embodiment, the apparatus further comprises a tensioning device which is adapted to stress the packaging material, thereby causing or intensifying forces in the region of the cutting pattern, by means of which forces the opening of the packaging material is brought about or supported. Preferably, the manner in which the packaging material opens along the cutting pattern can be predetermined by means of the tensioning device, since the direction of the forces caused or intensified can be freely selected through the arrangement of the tensioning device relative to the value document package to be opened and/or the cutting pattern.

In a further preferred embodiment, the tensioning device is also adapted to remove the opened packaging material from the value documents located in the value document package. Preferably, the tensioning device strips the packaging material off the value documents perpendicularly to the cutting pattern. This ensures a particularly rapid opening of the value document package and removal of the packaging material.

Preferably, the tensioning device is also adapted to stress the packaging material by applying a tug, i.e. with at least a force that builds up over a short period of time. The force thereby acting in the region of the cutting pattern leads particularly reliably to an opening of the packaging material.

In a further preferred embodiment, the tensioning device has at least one rubberized roller. The rubber coating advantageously increases the friction between the roller of the coil device and the packaging material.

In order to further increase the friction between the roller and the packaging material, the coil device is also adapted to press the roller onto the value document package at a predetermined pressure.

When at least two rollers are preferably employed, these are arranged in parallel and are adapted to rotate in opposite directions in such a manner that the packaging material, which is in friction-locked contact with the rollers, is tensioned in a region between the rollers. As a result, the forces required for opening the packaging material are produced in a particularly reliable manner.

BRIEF DESCRIPTION OF THE DRAWINGS

Further advantages, features and application possibilities of the present invention will result from the following description in connection with the figures. There are shown.

DETAILED DESCRIPTION OF VARIOUS EMBODIMENTS

Figure 1:
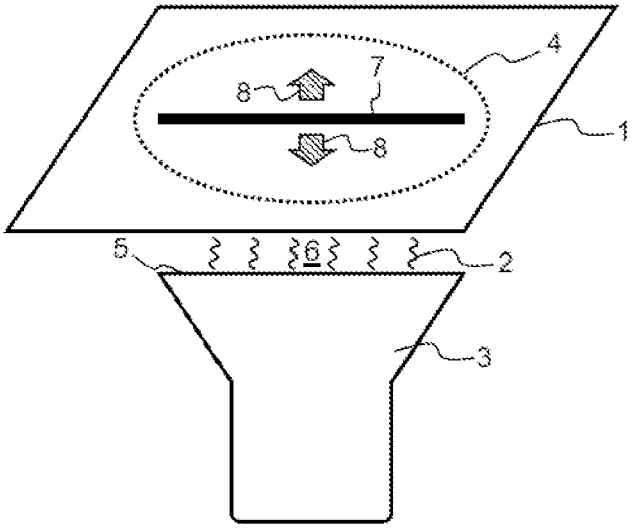
FIG. 1 an example of a packaging material of a value document package and a hot air nozzle in a perspective view.

FIG. 1 shows an example of a section of a packaging material 1 with which value documents (not shown) are packaged. The represented section of the packaging material 1 forms, for example, a side wall or a part of a side wall of a substantially cuboid value document package (not shown).

Hot air 2, which is produced, for example, by a hot-air blower, is guided through a hot air nozzle 3 arranged in the vicinity of the packaging material 1. The packaging material 1 is heated in a region 4 by the hot air 2. The distance between the hot air nozzle 3 and the packaging material preferably amounts to between approximately 1 and 30 mm, in particular between 3 and 15 mm. In the example shown, however, the distance between the hot air nozzle 3 and the packaging material 1 is represented clearly greater for reasons of clarity.

The shape of an opening 5 of the hot air nozzle 3 determines the shape of the hot air flow 6 impinging on the packaging material 1. In the example shown, the hot air nozzle 3 has a line-shaped opening 5, so that hot air 2 flowing out of the opening 5 generates a hot air jet 6 with a substantially linear cross section.

When the hot air jet 6 impinges on the packaging material 1, the hot air 2 heats the packaging material 1 in the region 4, which does not necessarily correspond to the cross section of the hot air jet 6 upon exiting from the hot air nozzle 3 and, in particular, can have a larger surface area. This is due, in particular, to heat conduction in the packaging material 1 and/or turbulences of the hot air 2.

The strongest heating of the packaging material 1 takes place along a region at the center of the region 4, which is referred to as cutting pattern 7. The high temperatures, which are preferably between 120 and 250° C., bring about a softening of the packaging material 1 there, by loosening or at least reducing or at least reducing cohesion forces between atoms or molecules and/or unknotting polymers or molecule chains.

Through the line-shaped opening 5 of the hot air nozzle 3 and the resulting, substantially linear cross section of the hot-air jet 6, the heat is concentrated on the surface of the packaging material 1 substantially along a line, so that the cutting pattern 7 in the present example is also line-shaped.

The packaging material 1 is preferably configured as a shrink foil, for example made of a polyolefin, which contracts during heating, but can also be employed for any other packaging material that is softened or weakened by heating. During the application of hot air 2 and the shrinkage of the foil caused thereby, in the region 4, in particular in the region of the cutting pattern 7, forces are produced through which the softened packaging material 1 is pulled apart, and finally partially torn, along the cutting pattern 7, which is indicated by arrows 8.

The resulting opening along the cutting pattern 7 can increase further, until the heating by means of hot air 2 is stopped or the packaging material 1 has reached a state in which it cannot shrink further.

This opening process can be influenced by various parameters. For example, the temperature of the hot air 2 flowing out of the opening 5 of the hot air nozzle 3 can be adjusted such that an opening of the packaging material 1 in the region 4 takes place more rapidly or more slowly. For this purpose, the distance between the hot air nozzle 3 and the packaging material 1 can also be varied. As a result, the size of the region 4 can be influenced additionally.

The heating of the packaging material by means of hot air has the particular advantage in comparison to other methods, in which the value document package is cut open, for example by means of a laser beam, that tolerances or variations of the distance between the hot air nozzle 3 and the packaging material 1 can be relatively large, without the opening process being noticeably impaired.

Figure 2A:
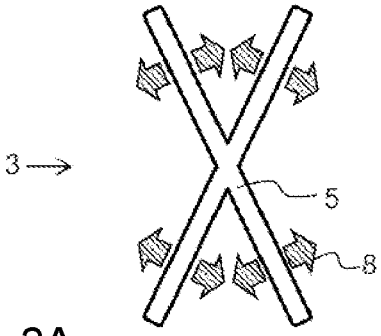
FIGS. 2A and 2B a first example and a second example of shapes of an opening of a hot air nozzle in a plan view, respectively.
Figure 2B:
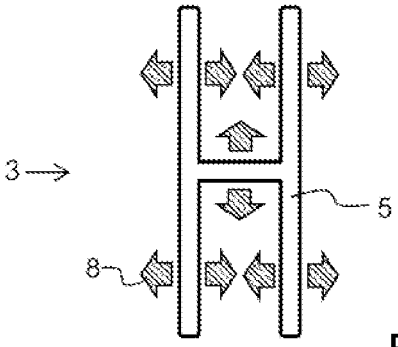

The forces resulting from the heating in the region 4, in particular the direction of action thereof, can also be influenced by the shape of the opening 5 of the hot air nozzle 3, which is illustrated by a first example in FIG. 2A and a second example in FIG. 2B, respectively.

FIG. 2A and FIG. 2B show two examples of the shape of the opening 5 of a hot air nozzle 3 in a plan view. In the first example, as shown by FIG. 2A, the opening is configured in an X-shape, and in the second example, as shown by FIG. 2B, the opening is configured in an H-shape.

Through the X-shaped opening 5 of the hot air nozzle 3, the hot air jet flowing out has a substantially X-shaped cross section. When the opening 5 of the hot air nozzle 3 is arranged sufficiently closely to the packaging material 1, this leads to a substantially X-shaped concentration of hot air in the packaging material. The corresponding cutting pattern is therefore likewise X-shaped.

In the second example, the hot air jet, due to the H-shaped opening 5 of the hot air nozzle 3, has an H-shaped cross section. Accordingly, the cutting pattern on the packaging material is also H-shaped.

The hatched arrows 8 indicate that the packaging material 1 pulls apart along the respective cutting pattern and opens while so doing.

In addition to an X- or H-shaped opening 5, a plurality of further shapes are conceivable, through which the region 4 of the packaging material is broken down into several partial regions, through which the packaging material can be opened and removed in a particularly reliable and simple manner.

For example, point-shaped hot air nozzles 3 can be used. The point-shaped hot air nozzles 3 can be arranged as desired in order to produce any desired cutting pattern.

Further, it is possible, by means of a transport device, to move the hot-air nozzle or hot air nozzles or the packaged value documents in such a manner that a relative movement between the packaging material and the hot air nozzle or hot air nozzles arises. When, for example, a point-shaped hot air nozzle is used, a cutting pattern arises in accordance with the relative movement, for example a line. When, for example, a line-shaped hot air nozzle is used, an areal cutting pattern arises through the relative movement, for example over an entire surface of the packaged value documents.

Figure 3:
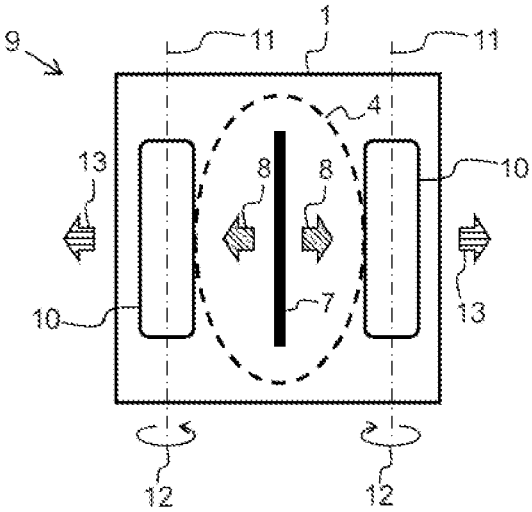
FIG. 3 an example of a tensioning device in a plan view.

FIG. 3 shows an example of a tensioning device 9 in a plan view. The tensioning device 9 is arranged above the packaging material 1 and has two rollers 10, which can rotate about a respective roller axis 11. For this purpose, the two rollers 10 are driven by a suitable drive (not shown), for example an electric motor. The direction of rotation of the two rollers 10 is indicated by the curved arrows 12.

When the two rollers 10 are in friction-locked contact with the packaging material 1, the packaging material 1 is tensioned in the region 4 between the two rollers 10 by a torque applied to the rollers 10.

When hot air is applied to the region 4, the packaging material 1 softens along the cutting pattern 7. The forces produced by the tension in the interior of the packaging material 1 bring about an opening of the packaging material 1 along the cutting pattern 7. The direction of the forces acting during the opening is indicated by the arrows 8.

As a result, the packaging material 1 opens even if it does not contract or contracts only slightly during the heating by means of hot air, for example when it is not configured as a shrink foil.

Preferably, the packaging material 1 is not only tensioned by the tensioning device 9, in order to bring about or support an opening of the material along the cutting pattern 7, but, after the completed opening, is also removed from the value documents contained in the value document package, in particular by pulling off along the direction of the arrows 13. For this purpose, the two rollers 10 rotate further in the opposite rotation direction 12 after the opening has taken place, and, while so doing, push the packaging material 1 or parts of the packaging material 1 out laterally between the value documents and the rollers 10.

Since forces arise along the edges of the packaged value documents during the heating of the packaging material 1, it is also possible to employ only one of the rollers 10 for producing the previously described tension for opening the packaging material.

Figure 4:
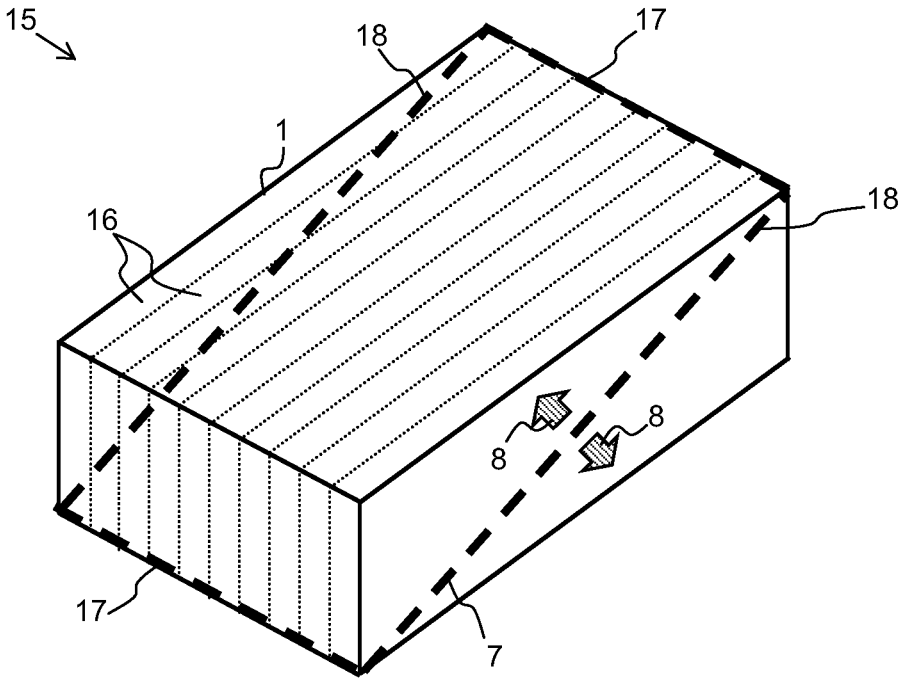
FIG. 4 a first example of the profile of a cutting pattern for the removal of packaging material from a pack.

FIG. 4 shows by way of example ten packs 16 of 100 banknotes each, which are packaged into a packet 15 by means of packaging material 1. In order to remove the packaging material 1, a cutting pattern 7 is employed that extends along two edges of the two narrow sides of the packet 15, and diagonally over the areas of the two longitudinal sides of the packet 15. The direction of the forces acting during the opening is indicated by the arrows 8.

The cutting pattern 7 according to FIG. 4 has the advantage that the packaging material 1 is opened along the edges of the packet 15 in such a manner that the packaging material 1 no longer has to be pulled over edges of the packet 15 in order to be removed.

The cutting pattern 7 according to FIG. 4 can be produced, for example, with the above-described point-shaped hot air nozzle and a transport device, which produces a relative movement between the packet 15 and the hot air nozzle, which relative movement corresponds to the cutting pattern 7. In another possibility, it is provided to employ one or several line-shaped hot air nozzles, which are arranged along the lines 17, 18 of the cutting pattern 7.

Figure 5:
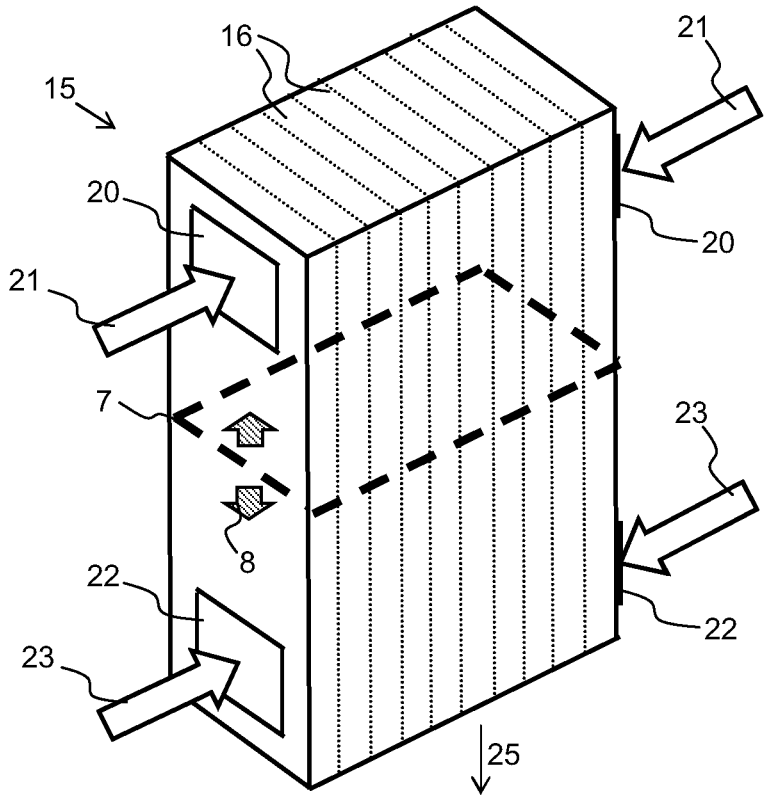
FIG. 5 a second example of the profile of a cutting pattern for the removal of packaging material from a pack.

FIG. 5 shows by way of example ten packs 16 of 100 banknotes each, which are packaged into a packet 15 by means of packaging material 1. In order to remove the packaging material 1, a cutting pattern 7 is employed that extends around the circumference of the packet 15. The direction of the forces acting during the opening is indicated by the arrows 8.

During the production of the cutting pattern 7 according to FIG. 5, the packet 15 is clamped by means of clamping jaws 20 and 22. For example, a clamping force 21 acts on the clamping jaws 20, which is greater than the force 23 acting on the clamping jaws 22. After the production of the cutting pattern 7, the packaging material 1 can then be removed from the packet 15 by means of the clamping jaws 22, on which the smaller force 22 acts. The clamping jaws 21, 23 advantageously have a friction lining directed towards the packaging material 1, in particular for the previously described removal of the packaging material 1.

The cutting pattern 7 according to FIG. 5 can be produced, for example, with the above-described point-shaped hot air nozzle and a transport device, which produces a relative movement between the packet 15 and the hot air nozzle, which relative movement corresponds to the cutting pattern 7. In a further possibility, it is provided to employ one or several line-shaped hot air nozzles, which are arranged along the cutting pattern 7.

The invention claimed is:

1. A method for opening value document packages in which value documents are packaged with a packaging material, the method comprising:

providing a heating apparatus that includes at least one hot-air nozzle having an opening, the opening of the hot-air nozzle being H shaped, X-shaped, M-shaped or L-shaped;

heating a region of the packaging material with hot air from the hot-air nozzle such that the packaging material opens along a cutting pattern in the shape of the hot-air nozzle.

2. The method according to claim 1, wherein the cutting pattern is an H shaped, X-shaped, M-shaped or L-shaped cutting pattern.

3. The method according to claim 1, wherein the packaging material is softened or weakened along the cutting pattern by the heating with hot air.

4. The method according to claim 1, wherein the packaging material is configured as a shrink foil that contracts during the heating such that the shrink foil opens along the cutting pattern on account of forces arising in the region of the cutting pattern.

5. The method according to claim 1, wherein the packaging material is tensioned by a tensioning device in such a manner that forces are caused or intensified in the region of the cutting pattern by means of which forces the opening of the packaging material is brought about or supported.

6. The method according to claim 5, wherein the packaging material is removed after the opening from the value documents located in the value document package by the tensioning device.

7. The method according to claim 5, wherein the packaging material is removed by being pulled off by the tensioning device after the opening from the value documents located in the value document package.

8. The method according to claim 1, wherein the value documents of the value documents packages are held together by a pre-bundling foil that connects with the packaging material.

9. The method according to claim 1, further comprising tensioning the packaging material with a tensioning device that includes a first rubberized roller and a second rubberized roller arranged in parallel.

10. The method according to claim 9, further comprising rotating the first rubberized roller and the second rubberized roller in opposite directions such that the packaging material, which is in friction-locked contact with the first rubberized roller and the second rubberized roller, is tensioned in a region between the rollers.

11. The method according to claim 10, further comprising pushing the packaging material or parts of the packaging material out laterally between the value documents and the first and second rubberized rollers while the first and second rubberized rollers rotate in said opposite directions.

12. The method according to claim 1, wherein heating the region of the packaging material includes placing the hot-air nozzle at a distance between 3 and 15 mm from the packaging material.

13. The method according to claim 1, wherein heating the region of the packaging material includes heating the packaging material to a temperature between 120° C. and 250° C.

14. An apparatus for opening value document packages in which value documents are packaged with a packaging material, the apparatus comprising:

at least one hot-air nozzle that is adapted to heat a region of the packaging material with hot air such that the packaging material opens along a cutting pattern, wherein an opening of the hot-air nozzle is H shaped, X-shaped, M-shaped or L-shaped.

15. The apparatus according to claim 14, having a tensioning device, which is adapted to tension the packaging material, as a result of which forces are caused or intensified in the region of the cutting pattern, by which forces the opening of the packaging material is brought about or supported.

16. The apparatus according to claim 15, wherein the tensioning device is further adapted to remove the opened packaging material from the value documents located in the value document package.

17. The apparatus according to claim 15, wherein the tensioning device has at least one rubberized roller.

18. The apparatus according to claim 14, wherein a transport device produces a relative movement between the hot air nozzle and the packaging material.

19. A system for opening value document packages, the system comprising:

a value document package having a plurality of value documents packaged with a packaging material, and an apparatus that includes at least one hot-air nozzle that is adapted to heat a region of the packaging material with hot air such that the packaging material opens along a cutting pattern, wherein an opening of the hot-air nozzle is H shaped, X-shaped, M-shaped or L-shaped.

20. The system according to claim 19, wherein the packaging material is configured as a shrink foil that contracts when heated and that opens along the cutting pattern on account of forces arising thereby in the region of the cutting pattern during the heating.

* * * * *